United States Patent [19]

Holson

[11] 4,019,937

[45] Apr. 26, 1977

[54] SLEEVED PHOTO ALBUM PAGE AND MEANS AND METHOD FOR MAKING SAME

[75] Inventor: Sheldon Holson, Norwalk, Conn.

[73] Assignee: The Holson Company, Wilton, Conn.

[22] Filed: Apr. 5, 1976

[21] Appl. No.: 673,448

[52] U.S. Cl. ..... 156/73.1; 156/201; 156/202; 156/203; 156/204; 156/216; 156/227; 156/265; 156/297; 156/466; 156/517; 156/538

[51] Int. Cl.[2] ..... B31B 23/60; B31B 23/74

[58] Field of Search ..... 156/200, 201, 203, 204, 156/217, 227, 256, 297, 265, 299, 324, 465, 510, 556, 73.1, 202, 216, 466, 517, 538; 229/68 R, 71; 40/124.1; 282/11.5 R; 206/44.12, 45; 108/92, 97; 53/28, 177; 93/1 F, 61 R

[56] References Cited

UNITED STATES PATENTS

| | | | |
|---|---|---|---|
| 2,272,623 | 2/1942 | Runner | 229/71 |
| 2,326,919 | 8/1943 | Becker | 229/68 R |
| 2,614,349 | 10/1952 | Barnes | 156/201 |
| 2,688,829 | 9/1954 | Geffroy et al. | 53/177 |
| 3,420,149 | 1/1969 | Middleditch et al. | 93/61 R |
| 3,525,470 | 8/1970 | Carrigan | 229/68 R |
| 3,617,420 | 11/1971 | McCann | 156/556 |
| 3,785,910 | 1/1974 | Parry | 156/580.1 |
| 3,951,050 | 4/1976 | Poole | 93/1 F |

*Primary Examiner*—Charles E. Van Horn
*Assistant Examiner*—Basil J. Lewris
*Attorney, Agent, or Firm*—Charles E. Temko

[57] ABSTRACT

The application discloses a means and method for manufacture and assembly of a known pivotally mounted sleeve-type photographic print display device. The display device comprises a relatively rigid planar cardboard base to which there are pivotally attached to at least one surface thereof in mutually staggered relation, a plurality of individual open-ended flattened sleeves, each having a paper insert of congruent dimensions. Attachment to the base is by an adhesive strip which forms a hinge. The method of manufacture and assembly includes the steps of forming a continuous web comprising a paper strip enclosed by a strip of clear synthetic resinous material forming a fold edge and a pair of oppositely disposed abutted longitudinal edges, sealing the abutted edges to form a continuous sleeve, applying a continuous strip of adhesive material to one surface of said sleeve in the area of said abutted edges to extend laterally therefrom and expose an unadhered adhesive surface, cutting the web transversely at uniform intervals to form individual sleeve elements, providing a jigging structure for receiving a predetermined number of individual sleeve elements in mutually spaced parallel relation with exposed portions of said adhesive strip projecting outwardly therefrom, and pressing said jigging structure against a surface of a base element to adhere the projecting portions of the adhesive strips thereto. The means for accomplishing the above steps semi-automatically includes an elongated guide element for assembling the continuous web, an ultrasonic sealing means for sealing the above-mentioned abutted edges, means for laminating the adhesive strip thereto, means severing the web and feeding the severed segments thereof in timed relation with the advancement of said jigging means past a loading station.

5 Claims, 12 Drawing Figures

SLEEVED PHOTO ALBUM PAGE AND MEANS AND METHOD FOR MAKING SAME

BACKGROUND OF THE INVENTION

It is known in the art to provide photographic print display devices of the type disclosed herein, such devices providing for the storage of a plurality of photographic prints in back-to-back relation within individual transparent sleeves, the sleeves being interconnected in staggered relation to a rigid strip-like base or "page." A plurality of such pages are stored in supported parallel relation within an open-ended container, resembling in some respects a conventional business card file, whereby individual pages may be withdrawn for serial examination of the stored prints by rotating the sleeves through substantially 180° to successively expose each side of the individual page.

This construction has found considerable acceptance among the purchasing public owing to the simplicity of mounting a large number of prints in semi-permanent fashion, for ready replacement when desired, and because of the ability to display a large number of prints in rapid succession while requiring only limited storage space per print, as compared with a relatively large surface area per page required in conventional album constructions. However, because of the many hand operations previously required for formation of the individual components, and subsequent assembly, the cost of such construction has remained relatively high.

SUMMARY OF THE INVENTION

Briefly stated, the invention contemplates the provision of novel means and associated method for the fabrication and assembly of the above-described photographic print display structure, whereby the cost of fabrication and ease of assembly may be materially enhanced. The method includes the steps of forming a continuous web consisting of a folded flattened envelope of clear synthetic resinous material, open along a pair of abutted longitudinal edges, and a paper strip enclosed thereby. During subsequent steps, the above edges are sealed by ultrasonic means, and a strip of adhesive tape is applied to an area adjacent the sealed edges in such manner that an adhesive surface thereof projects laterally from the axis of the web. The web is subsequently severed at equally spaced intervals to form open-ended sleeve elements, which are positioned in mutually parallel relation in a jigging structure in such manner that the severed adhesive strip segments project therefrom. The jigging structure is subsequently abutted against a surface of a base or "page" whereby the exposed adhesive surfaces of individual adhesive strip segments are pressed thereagainst to attach the sleeve elements thereto in hinged relation.

The disclosed means includes elements which perform the above steps in substantially automatic manner up to the loading of the jigging structures, the final attachment of the sleeve elements to a surface of the base or page being a manual operation.

BRIEF DESCRIPTION OF THE DRAWINGS

In the drawings, to which reference will be made in the specification, similar reference characters have been employed to designate corresponding parts throughout the several views.

DETAILED DESCRIPTION OF THE DISCLOSED EMBODIMENT

Figure 10:
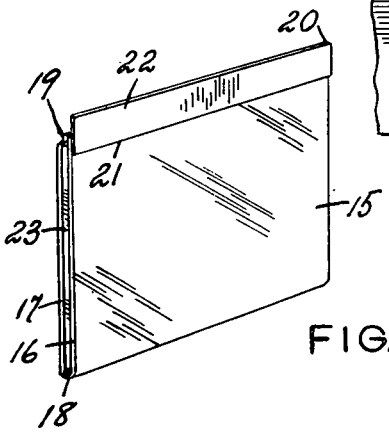
FIG. 10 is a view in perspective showing an individual sleeve element in unattached condition.
Figure 11:
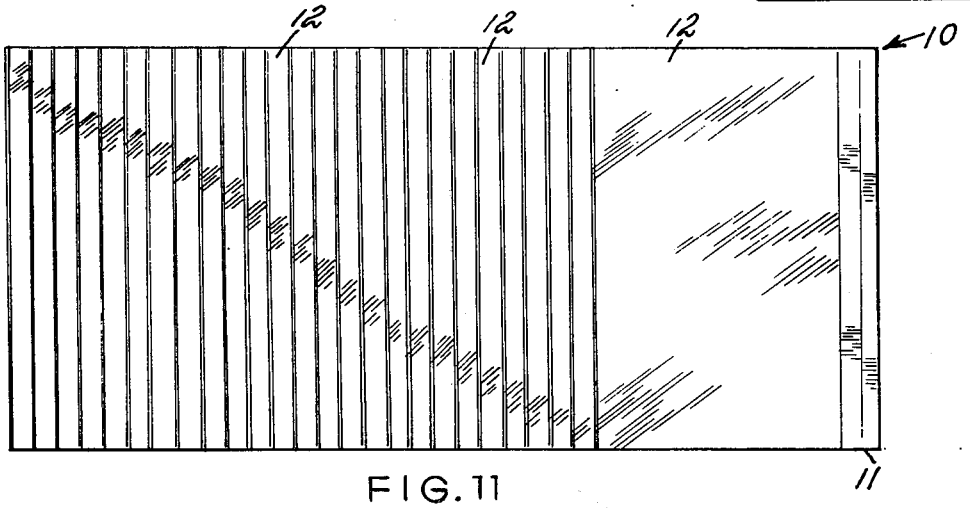
FIG. 11 is a view in elevation of a completed display device.
Figure 12:
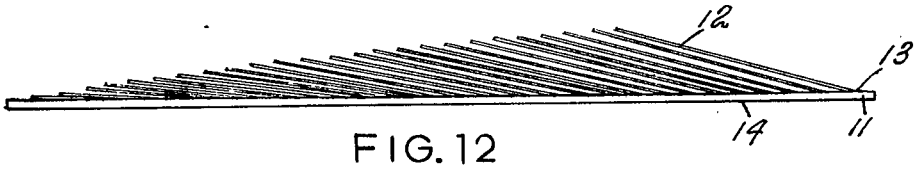
FIG. 12 is a view in elevation as seen from the lower portion of FIG. 11.

Before entering into a consideration of the means and method disclosed, a brief consideration of the article formed is considered apposite. Referring to FIGS. 10, 11 and 12, the device, generally indicated by reference character 10, comprises broadly a base 11 of smoothly calendered cardboard, and a plurality of sleeved envelopes 12 pivotally adhered to one or both surfaces 13 and 14. As best seen in FIG. 10, each of the sleeved elements 12 includes an open-ended transparent sleeve member 15 formed at first and second planar walls 16 and 17, respectively, and interconnected by a fold edge 18 and a sealed edge 19. A strip of adhesive tape 20 forms a hinge, and includes a first portion 21 secured to the sleeve element, and a second portion 22 secured to the base 11. An optional paper filler 23 adds stiffness to the sleeve, and facilitates the introduction of a pair of paper photographic prints (not shown) in back-to-back relation.

Figures 1, 2, 3, 4:
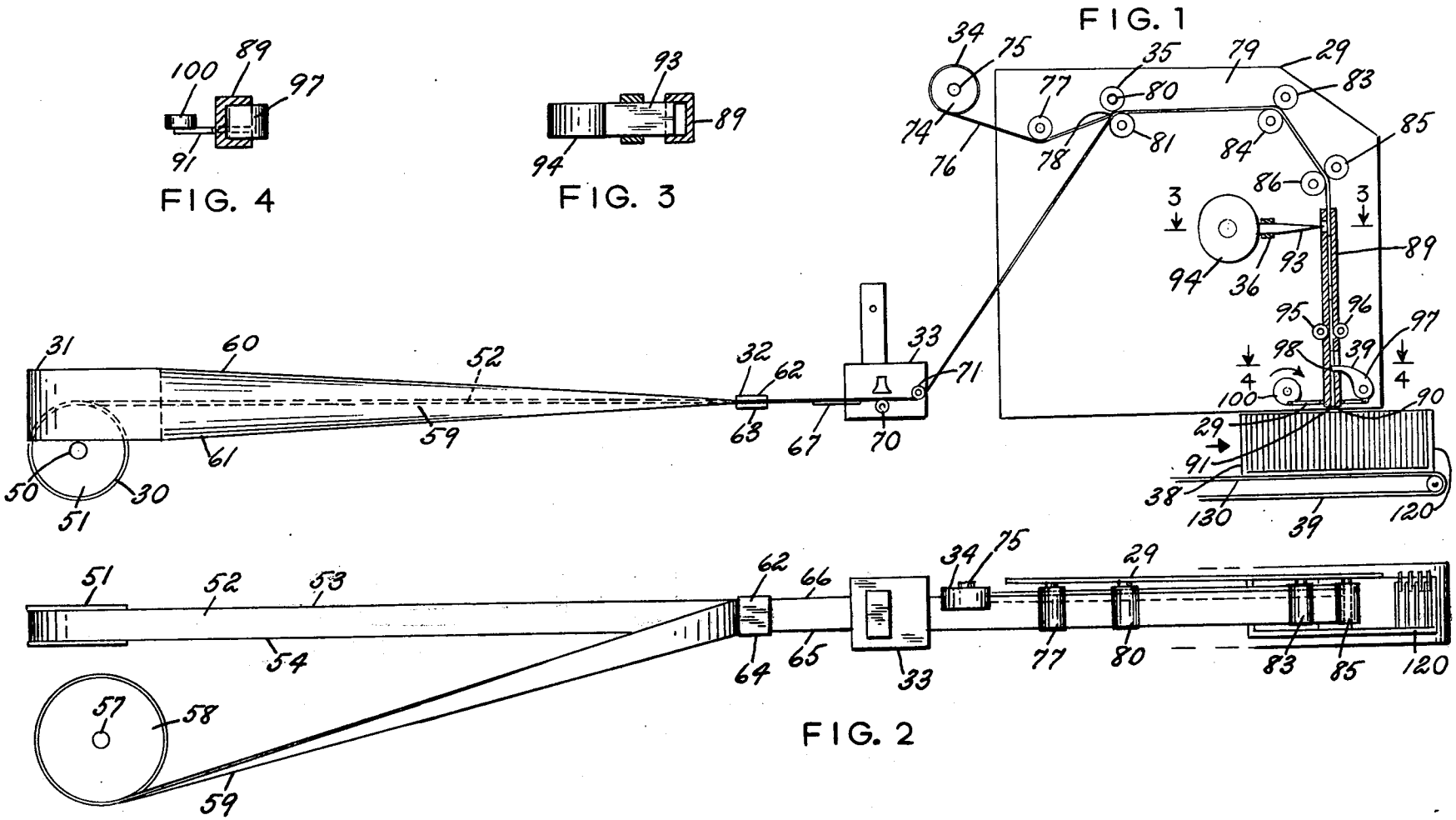
FIG. 1 is a schematic, fragmentary side elevational view of an embodiment of the invention.
FIG. 2 is a fragmentary top plan view thereof.
FIG. 3 is an enlarged fragmentary sectional view as seen from the plane 3—3 in FIG. 1.
FIG. 4 is an enlarged fragmentary sectional view as seen from the plane 4—4 in FIG. 1.

Referring to FIG. 1, there is schematically illustrated a semi-automatic means, generally indicated by reference character 29, which performs the function of fabricating the sleeved elements 12 and positioning them in jigging structure in mutually spaced parallel relation, so they may be simultaneously attached to a base member 11. The means 29 comprises broadly: a paper web supply element 30, a film web supply element 31, fold forming means 32, ultrasonic sealing means 33, a tape web supply element 34, driving means 35, cutting means 36, gating means 37, plural jigging means 38 and jig incremental advancement means 39.

The paper web supply element 30 includes a spindle 50 supporting a roll 51 from which a paper web 52 emanates. The web is of a width slightly less than the overall width of the elements 12, and is bounded by first and second edges 53 and 54.

The film web supply element 31 includes a spindle 57 mounting a roll 58 from which a film web 59 emanates. In the preferred embodiment, the web is formed from clear sheet vinyl material, although cellulosic stock of thin guage may be substituted. As best seen from a comparison of FIGS. 1 and 2, the film web 59 is slightly greater than twice the width of the paper web 52, and is bounded by first and second edges 60 and 61, respectively.

The fold forming means 32 serves the function of folding the film web 59 about the paper web 52 to sandwich the latter between the former. It includes first and second walls 62 and 63 which overlie the webs, and at least one U-shaped wall 64 which forms a fold edge 65 from a medial portion of the film web 59. Opposite the fold edge 65 are a pair of abutted edges 66. The folded web of film with enclosed paper web moves rightwardly as seen on FIGS. 1 and 2 to the ultrasonic sealing means 33 on a horizontal platform 67.

The ultrasonic sealing means 33 is of conventional type, including a pair of sealing rollers 70 and 71 which overlie areas adjacent the abutted edges 66 to form a sealed edge 72.

The tape web supply element 34 includes a roll of paper tape 74 gummed on one side and supported by a spindle 75. A web 76 emanates from the roll 74 and passes about a guide roller 77 to a point of attachment 78 within the housing 79 of driving means 35.

The driving means 35 includes a plurality of driven nip rollers 80, 81; 83, 84; 85 and 86; the last mentioned pair being disposed adjacent the upper end 88 of vertical guide 89. The lower end 90 thereof forms a discharge opening 91 adjacent a loading station 92.

The cutting means 36 (FIGS. 1 and 3) includes a reciprocating blade 93 resiliently urged by spring means (not shown) against an eccentric cam 94 to operate in synchronism with the driving means 35. Disposed below the blade 93 are a pair of driven nip rollers 95 and 96 which moves severed segments of the web to the gating means 37.

The gating means 37 includes a pivoted gate member 97, an outer end 98 of which projects into the path of severed segments of the web. A lever arm 29 is driven by a cam 100 which operates in synchronism with the jig advancement means 39.

Figure 5:
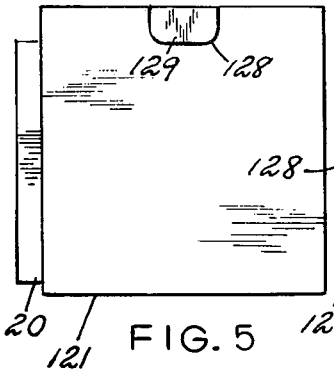
FIG. 5 is an end elevational view of one of the jigging structures comprising a part of the embodiment.
Figure 6:
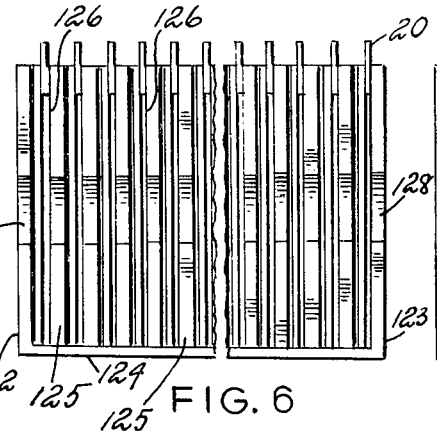
FIG. 6 is a top elevational view of one of the jigging structures, as seen from the right hand portion of FIG. 5.
Figure 7:
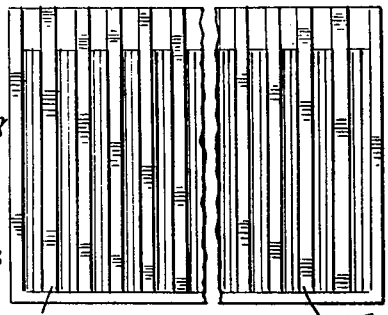
FIG. 7 is a side elevation view of one of the jigging structures as seen from the left hand portion of FIG. 5.

The jigging means 38 includes a plurality of jig elements 120, preferably at least three in number to assure continuous operation. The elements 120 are substantially similar, each including a bottom wall 121, end walls 122 and 123, a single side wall 124, and a plurality of septums 125 forming interstices 126 for the serial receipt of individual elements 12 as the same pass the gating means 37. As best seen in FIGS. 5 and 7, it will be observed that when loaded, the portions 22 of the strip of tape 20 on each element 12 project outwardly to permit them to be pressed against a surface of the member 11 simultaneously, using the end surfaces of the septums 125 to transmit pressure for securing the adhesive.

To assure alignment of each of the elements 12 within the jig elements 120, slots 128 are provided in each end wall 123–124 to accommodate an aligning bar 129 which is positioned as shown in FIG. 5, and which contacts an edge to align the same in co-planar relation with respect to the other elements 12 in the jig element 120. The bar 129 remains in position during the attachment of the elements 12 to the member 11.

The advancement means 39 includes an endless belt 130 arranged to advance individual jig elements 120 past the loading station formed by the discharge opening 91. Advancement is by a Geneva movement or equivalent driven in conjunction with the cam 100 which operates the gating means 37 by a gear train (not shown).

Figure 8:
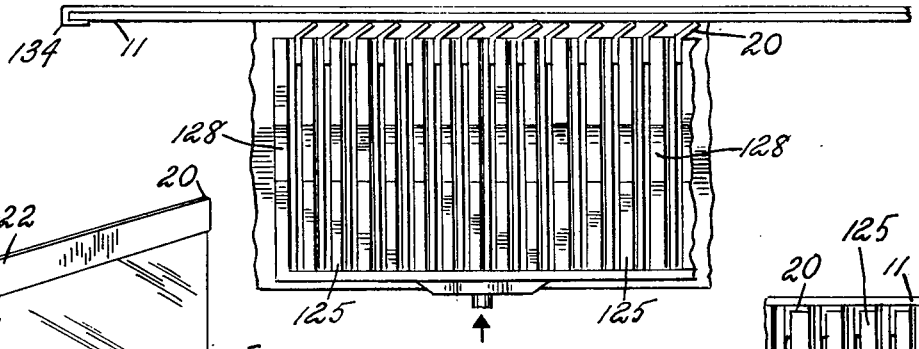
FIG. 8 is an enlarged fragmentary top plan view showing the attachment of individual sleeve elements to a base element.
Figure 9:
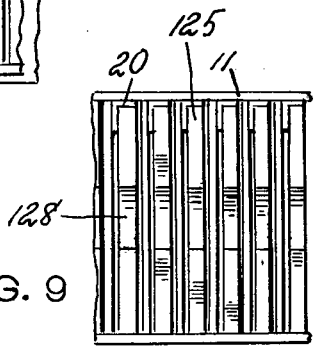
FIG. 9 is a fragmentary top plan view corresponding to that seen in FIG. 8, and showing the completion of the step illustrated in FIG. 8.

As filled jig elements 120 pass the loading station, they are manually removed by an operator, following which the interconnection of the elements 12 to a surface of member 11 is manually performed. Referring to FIG. 8, the precut members 11 are inserted at a fixed holder 134 following which the left wardmost side of the jig element 120, as seen in FIG. 5, is aligned as shown. Using mechanically induced pressure, e.g. a hydraulic press, the jig element 120 is pressed against the holder 134 wherein the portions 22 of the tape strip 20 are pressed as shown in FIG. 9, the edge surfaces of the individual septums 125 serving as an anvil to assure even distribution of pressure to secure the tape. Upon release of pressure, the jig element 120 is moved downwardly as seen in FIG. 9 to then permit removal of the member 11 from the holder 134, following which the attached elements 12 are manually flattened to the condition shown in FIGS. 11 and 12. The now empty jig element 120 is positioned on the belt 130 and moved to abut the leftwardmost jig element already on the belt to be refilled in proper order. If desired, mechanical means (not shown) may be provided for convenient return and repositioning of the jig elements.

Since the manual operations shown in FIGS. 8, 9 and 10 can be performed at a faster rate than the mechanical loading of the jig elements 120, the operator will have adequate time for performing his portion of the process. If desired, the manual functions of the operator may be eliminated, and means (not shown) for automatically pressing the jig elements 120 against serially positioned base members 11 may be provided.

I wish it to be understood that I do not consider the invention limited to the precise details of structure shown and set forth in this specification, for obvious modifications will occur to those skilled in the art to which the invention pertains.

I claim:

1. The method of making a photographic print display device, said device including a relatively rigid planar base and a plurality of open-ended sleeve elements hingedly attached thereto in staggered relation, comprising the steps of:

a. providing a rigid planar base having at least one surface for the attachment of said sleeve elements;
b. providing a web of clear heat-sealable synthetic resinous material of indeterminate length;
c. progressively folding said web along a principal longitudinal axis to form an envelope having a pair of abutted longitudinal edges;
d. progressively sealing said edges together to form a flattened sleeve having a pair of longitudinally extending edges;
e. applying a strip of adhesively-surfaced tape to a surface of said sleeve in an area adjacent a longitudinal edge thereof in such manner that a longitudinally extending adhesive-bearing area thereof extends laterally from said edge;
f. serially severing said sleeve and tape at substantially uniformly spaced intervals to form a plurality of open-ended sleeve elements;
g. providing a jigging structure for supporting said sleeve elements in mutually spaced parallel relation with said adhesive laterally-extending areas of said tape projecting therefrom;
h. while maintaining said sleeve elements within said jigging structure, pressing said jigging structure against a surface of said base to simultaneously adhere each of said adhesive laterally extending areas thereto; and i. removing said sleeve elements from said jigging structure.

2. In the method set forth in claim 1, the additional step of introducing a continuous web of paper of width corresponding to that of said envelope prior to the sealing of said abutted edges.

3. The method in accordance with claim 1, in which the sealing of said abutted edges of said envelope is by ultrasonic means.

4. Means for manufacturing a photographic print display device comprising: means for supplying a continuous web of thermoplastic synthetic resinous material; means for progressively folding said web of synthetic resinous material to form an envelope having a folded longitudinal edge and a pair of abutted free edges; means receiving said envelope and progressively sealing said abutted edges together to form a continuous flattened sleeve; means applying a continuous strip of adhesive tape to a longitudinal edge of said sleeve to leave a laterally extending portion of said strip in unadhered condition; means receiving said sleeve and serially transversely severing the same to form a plurality of equally sized sleeve elements, said means including a loading station; at least one jigging structure defining a plurality of parallel interstices for receiving individual sleeve elements; and means incrementally advancing said jigging structure past said loading station in synchronism with the serial formation of individual sleeve elements.

5. Structure in accordance with claim 4, further characterized in the provision of means for supplying a continuous web of paper of given width to said means for progressively folding said web of synthetic resinous material, whereby upon the forming of an envelope, said folded longitudinal edge and pair of abutted free edges will enclose said web of paper.

* * * * *